United States Patent [19]

Stein

[11] 4,249,491

[45] Feb. 10, 1981

[54] MULTIPLE LIQUID HEATING AND CIRCULATING SYSTEM

[75] Inventor: John Stein, Spokane, Wash.

[73] Assignee: Kim Hotstart Manufacturing Co., Inc., Spokane, Wash.

[21] Appl. No.: 71,981

[22] Filed: Sep. 4, 1979

Related U.S. Application Data

[63] Continuation of Ser. No. 907,271, May 18, 1978, abandoned.

[51] Int. Cl.[3] ..... F02N 17/02

[52] U.S. Cl. ..... 123/142.5 R; 123/142.5 E; 123/196 AB; 165/107 R; 165/42; 165/51

[58] Field of Search ..... 123/142.5 R, 142.5 E, 123/196 AB, 41.33, 41.14; 165/107, 42, 51; 184/104 A

[56] References Cited

U.S. PATENT DOCUMENTS

| | | | |
|---|---|---|---|
| 2,070,615 | 2/1937 | Plante | 123/142.5 R |
| 2,623,612 | 12/1952 | Scheiterlein | 184/104 A |
| 3,134,374 | 5/1964 | Stevens | 123/142.5 E |
| 3,236,220 | 2/1966 | Holmes | 123/142.5 R |
| 3,373,728 | 3/1968 | Collins | 123/142.5 R |
| 3,400,700 | 9/1968 | Lindsey et al. | 123/142.5 R |
| 3,758,031 | 9/1973 | Moran | 123/142.5 R |
| 3,795,234 | 3/1974 | Stolz | 123/142.5 R |
| 3,853,270 | 12/1974 | Prebil | 123/142.5 R |
| 4,051,825 | 10/1977 | Elder | 123/142.5 R |

FOREIGN PATENT DOCUMENTS 7706060 12/1977 Netherlands .

*Primary Examiner*—Ira S. Lazarus

*Attorney, Agent, or Firm*—Wells, St. John & Roberts

[57] ABSTRACT

An apparatus for maintaining equipment, such as an engine, in readiness for use while it is otherwise nonoperational. The equipment or engine is of the general type having two or more closed liquid recirculation systems. The apparatus bypasses the usual recirculating pumps in such systems. External supply pumps remove liquid from separate sumps or reservoirs and divert the liquids from passage through the normal recirculating pumps of the recirculation systems. The diverted liquid is conditioned to a predetermined temperature by passage through a heat exchanger where one liquid warms or cools the other. The liquids, pressurized by operation of the supply pumps, are then redirected into the equipment recirculation systems downstream from the respective outlets of the recirculating pumps. The pressurized and temperature conditioned liquids are then forced through the equipment passages in the respective recirculation systems in a manner similar to normal liquid circulation during use of the equipment. This maintains the equipment at a temperature in readiness for use. In cases where one of the systems includes a recirculating lubricant, the apparatus also maintains proper lubrication of the equipment elements during periods in which the equipment is not in use.

4 Claims, 10 Drawing Figures

MULTIPLE LIQUID HEATING AND CIRCULATING SYSTEM

This is a continuation of application Ser. No. 907,271, filed May 18, 1978, now abandoned.

BACKGROUND OF THE INVENTION

This invention relates to the maintenance of idle equipment, such as internal combustion engines. Such equipment must often be used in environments which impose temperature levels on the equipment that are extremely different from the normal operating temperatures of the equipment. For instance, internal combustion engines used outdoors in northern climates through the winter are often exposed to subzero temperatures. Were the equipment to be stored at such temperatures, starting of the equipment might be impossible. At best, starting would be difficult and would subject the movable elements of the equipment to extraordinary wear. It is well known that lubrication fluids in nonoperational equipment such as engines experience a decrease in viscosity at lowered temperatures and also tend to drain from bearings and other lubricated surfaces over extended periods of time unless the equipment is periodically operated.

To counter these problems, many users of mechanical equipment in hostile or cold environments must maintain the equipment operational at all times. Internal combustion engines used outdoors are often operated or idled continuously to assure proper heating and lubrication of the equipment between periods of actual usage. Alternatively, many users of equipment such as engines, heat and pump coolant liquid through the equipment when it is not in use. Electrically heated elements and percolating heaters and valve arrangements for circulating coolant liquids through engine blocks are well known. However, heating the coolant is not satisfactory in the case of many heavy-duty engines, because the large aluminum pistons sometimes present in such engines draw such quantities of heat from the engine block that it is almost impossible to maintain a block temperature adequate to assure subsequent starting.

Another limitation of heaters that circulate coolant liquid through the block of an engine or through other equipment, is that this usually has little or no effect on its lubricating system. In an engine, the oil or lubricant normally drains by gravity to a lower pan or sump beneath the engine elements. Simply heating the engine block has little or no effect on the cold lubricant in the exposed pan beneath the block. Separate pan heaters are needed. Heating the engine block by circulating coolant fluid and heating lubricant stationary in an engine pan obviously has no lubricating effect on the engine components themselves while the engine is not in use.

The present invention was developed in an effort to maintain equipment such as internal combustion engines in operational readiness by circulating coolant or lubricating liquids through the equipment in much the same fashion as they are circulated when the equipment is operational. By substantially matching the operational circulation of such liquids, the machine elements are prelubricated when the liquid being circulated is the usual lubrication liquid. The lubricating fluid is maintained in a warm condition and the lubricated surfaces are maintained with a film of lubricant in readiness for subsequent movement. This is achieved while the normal equipment elements are stationary, and requires only a fraction of the energy that would otherwise be necessary to operate the equipment at an idle condition when not in use. Furthermore, this substantially reduces the wear on the equipment elements, since they can remain stationary while being warmed and/or lubricated.

DESCRIPTION OF THE PREFERRED EMBODIMENT

The invention is disclosed with respect to an internal combustion engine, which might be a diesel or gasoline powered engine of any conventional type. The engine might be in a stationary location, such as in a power plant, or it might be located in a vehicle, such as an automobile, truck, or railroad locomotive. The type of equipment or engine and its normal application during usage are irrelevant to an understanding of this invention. Furthermore, the apparatus is applicable to other types of equipment having multiple liquid recirculation systems, such as chemical processing equipment. The apparatus can be used to either extract heat from a liquid while the equipment is idle, or, more commonly, to add heat to two or more liquid systems.

As a general statement, the apparatus is applicable to equipment of the type having first and second closed liquid recirculation systems having first and second liquid supplies and associated first and second recirculating pumps. Each recirculating pump includes an inlet and an outlet. The respective recirculating pumps are adapted to direct pressurized liquids through the systems while the equipment is operational. The details of the closed liquid recirculation systems are not necessary to an understanding of the invention. Various stationary or moving elements in the equipment are normally supplied with a recirculating liquid that is pressurized by operation of one of the recirculating pumps. The pumps are normally operational when the equipment itself is operational. They draw fluid from the respective liquid supplies, pressurize it by pumping, and pass the pressurized fluid through the equipment. The equipment is then allowed to return to the liquid supply or sump for subsequent use. The liquid supply can be integral to the equipment or can be separate from it and connected by appropriate conduits. Various filters and other types of liquid conditioning devices can be interposed in the recirculating systems.

Figure 1:
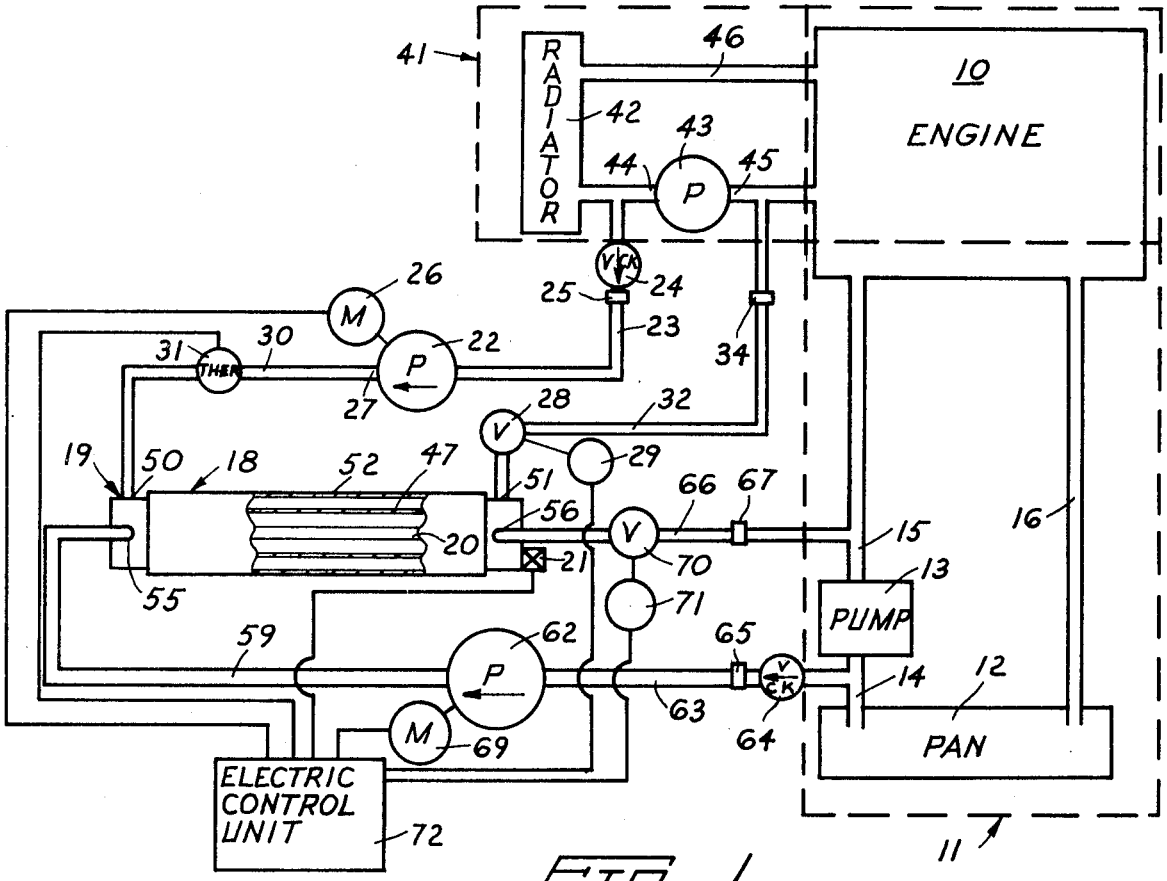
FIG. 1 is a schematic diagram of the present apparatus.
Figure 2:
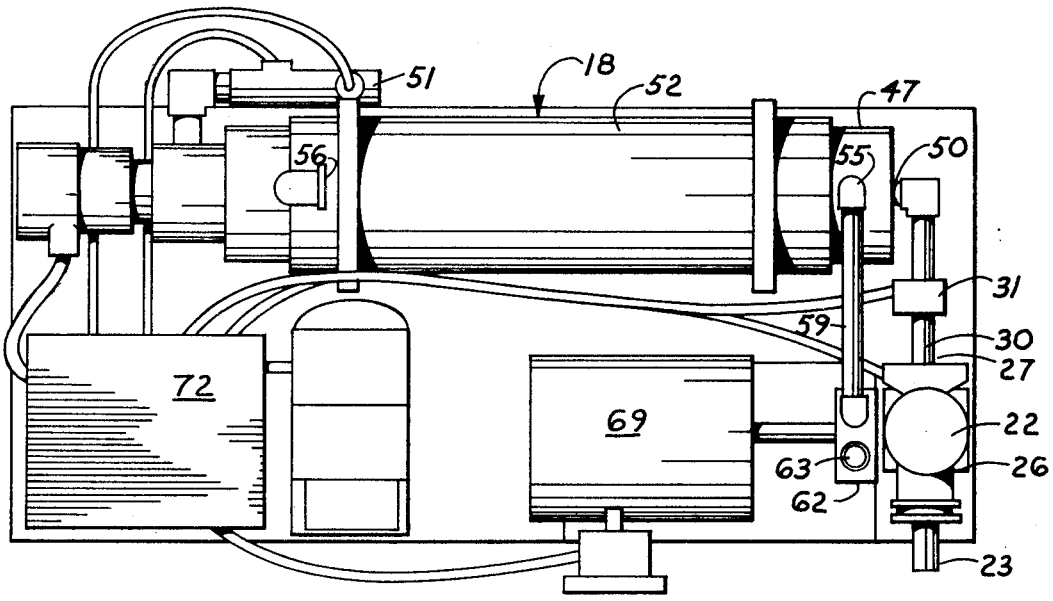
FIG. 2 is an elevation view of the apparatus.
Figure 3:
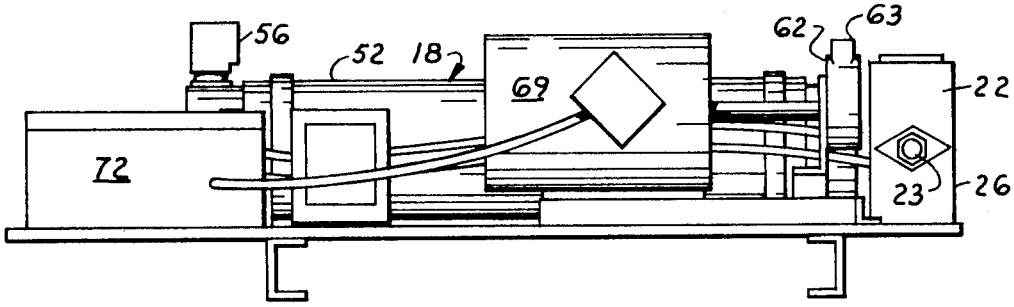
FIG. 3 is a plan view of the apparatus.
Figure 4:
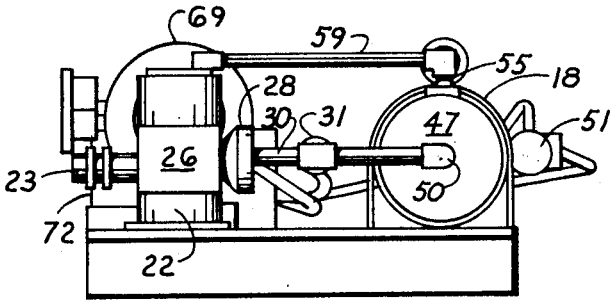
FIG. 4 is a right hand end view of the apparatus in FIG. 2.
Figure 5:
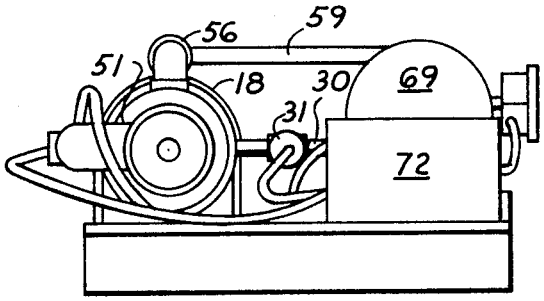
FIG. 5 is a left hand end view of the apparatus in FIG. 2.
Figure 7:
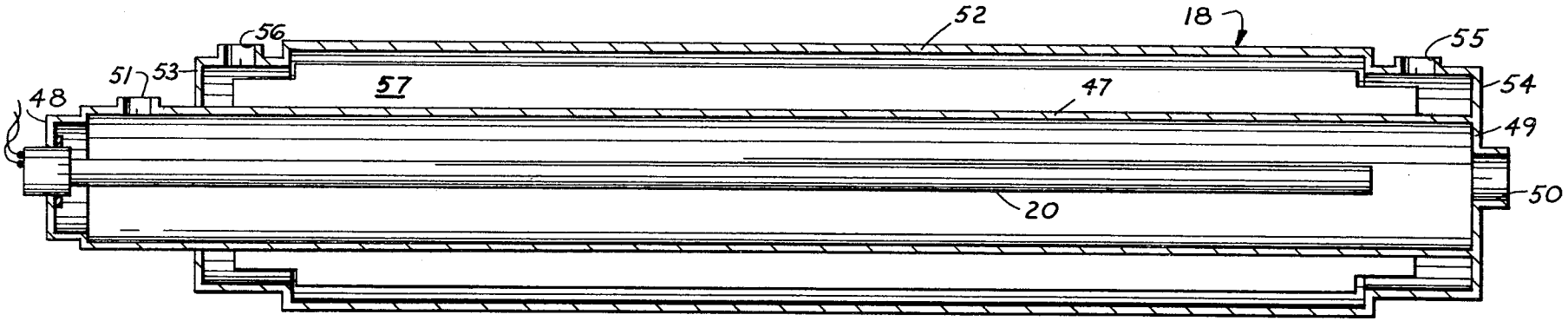
FIG. 7 is a longitudinal sectional view taken along line 7—7 in FIG. 6.
Figure 6:
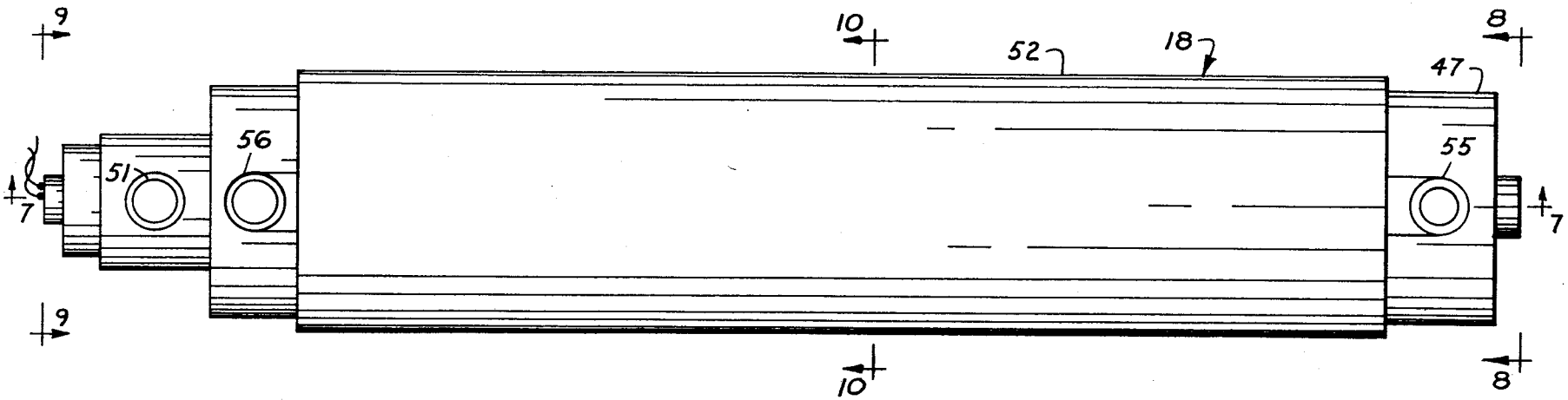
FIG. 6 is an enlarged plan view of the heat exchanger.
Figure 8:
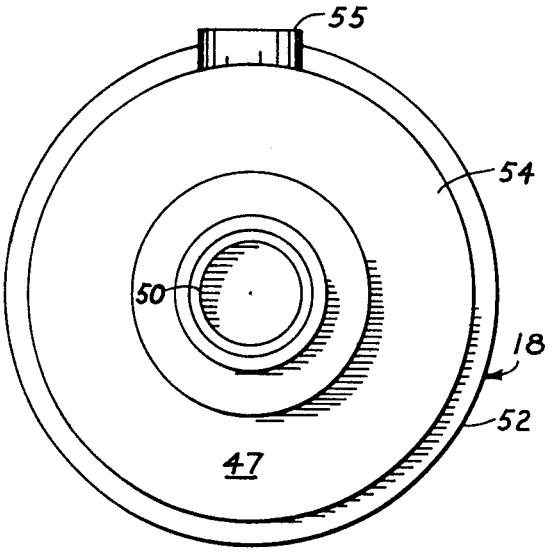
FIG. 8 is an end view as seen along line 8—8 in FIG. 6.
Figure 9:
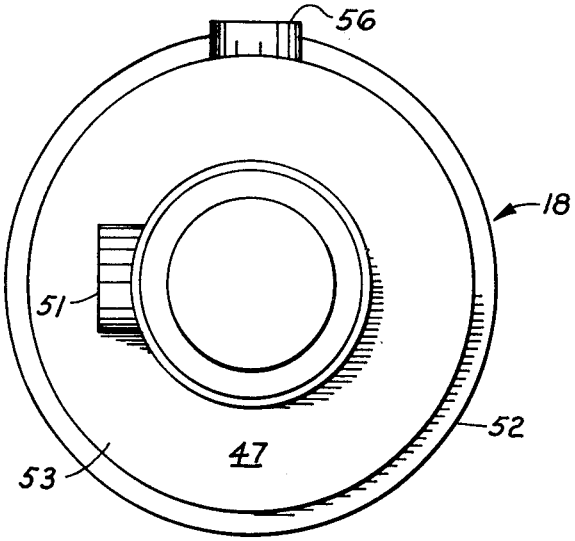
FIG. 9 is an end view as seen along line 9—9 in FIG. 6.
Figure 10:
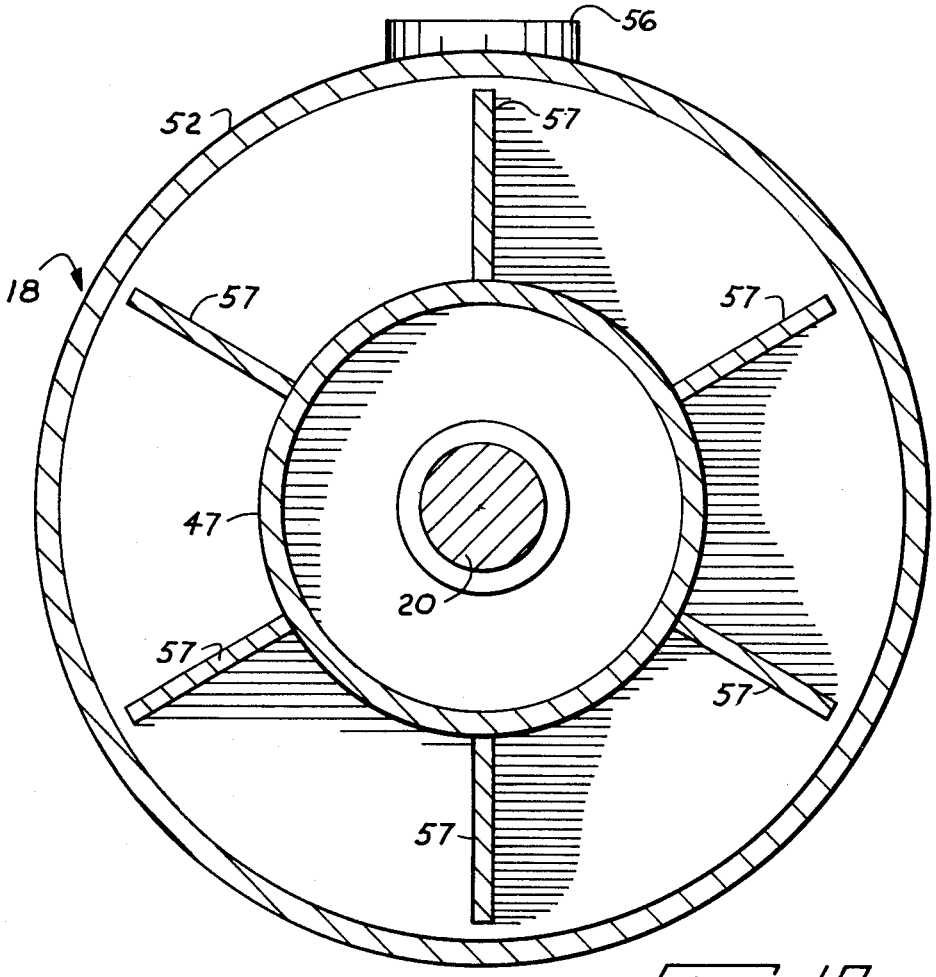
FIG. 10 is an enlarged cross-sectional view taken along line 10—10 in FIG. 6.

The apparatus is schematically illustrated in FIG. 1. A typical physical embodiment of the apparatus is shown in FIGS. 2 through 5.

Referring to FIG. 1, the equipment with which the apparatus is used is illustrated as generally comprising an internal combustion engine schematically shown at 10. The elements of engine 10 comprise part of two closed liquid recirculation systems schematically indicated as being within dashed line boundaries 11 and 41. The recirculating system 11 is shown as a lubricant oil system, while the recirculating system 41 is shown as a coolant system.

The recirculation system 11 further includes a liquid supply or sump 12. In the case of an internal combustion engine, the liquid supply 12 will be the usual pan beneath the engine, which collects the lubricant oil after its passage through the various engine elements.

The system 11 also includes a conventional recirculating pump 13. Again, in the case of an internal combustion engine, pump 13 is an oil pump powered during use of engine 10 and idle when engine 10 is not operational. Pump 13 basically has an inlet 14 in fluid communication with the liquid supply 12. It also has an outlet 15, which directs pumped lubricant under pressure to the various elements of engine 10.

For purposes of illustration, the schematic diagram also shows a conduit 16 for returning liquid to the liquid supply 12. The purpose is to visually illustrate the complete recirculating system. In the case of an internal combustion engine, the liquid supply 12 is usually a pan beneath the engine. The engine components are open to the pan and the lubricant oil drops into the pan from many different portions of the engine as it flows downward through the engine block and elements.

In any case, while the equipment is operational, the recirculating pump 13 supplies liquid from the liquid supply or sump 12 to the elements of the equipment in a continuous recirculating fashion. Various filters or other conditioning devices (not shown) can be interposed within the system in the usual fashion.

Many internal combustion engines include a second liquid recirculation system 41, primarily for circulation of coolant liquid through the engine components during use of the engine. As shown in FIG. 1, the system 41 typically comprises a radiator 42 within which the coolant is lowered in temperature. A coolant pump 43 has an inlet 44 in fluid communication with the lower portion of radiator 42. Outlet 45 of pump 43 directs the coolant under pressure to the various elements of engine 10 within the system 41. A conduit 46 returns liquid to the upper end of radiator 42 for cooling purposes. Again, filters and other conditioning devices, (not shown) can be interposed within system 41 as required.

Referring again to FIG. 1, the present apparatus is shown in the lower left hand corner. It comprises a conditioning tank 18 or heat exchanger within which liquid can be either heated or cooled. The details of the heat exchanger are shown in FIGS. 6 through 10.

The conditioning tank or heat exchanger 18 comprises two elongated liquid tanks, one surrounding the other in a coaxial arrangement. The first elongated tank is an interior tank defined by a cylindrical wall 47. It is arranged along a coaxial heating element 20. This might be an electrical resistance heating element operated by a heater control 21 mounted to one end of the tank 18. It is to be understood that the tank 18 might have many other physical configurations and might be heated or cooled by means external to it, as well as by an internal element as shown.

The elongated immersible heating element 20 has a central axis and an outer cylindrical surface centered about this axis. A cylindrical wall 47 is spaced radially from and surrounds the full length of the heating element 20. Wall 47 is centered along the axis of heating element 20. Suitable end walls 48 and 49 seal the interior of wall 47 to complete a first tank containing the space between wall 47 and heating element 20. As shown, a liquid inlet is provided to the first tank at 50. At the remaining end of the first tank, a liquid outlet is provided at 51.

A second cylindrical wall 52 is spaced radially from and surrounds the length of the first wall 47. This second wall is also centered along the axis of heating element 20. End walls 53 and 54 seal the interior of the second wall to complete a second tank containing the space between the first wall 47 and the second wall 52. An inlet 55 and an outlet 56 are provided to the interior of the second tank at opposite ends of it.

The first tank contained within the cylindrical wall 47 is preferably used for heating of coolant liquid received from the engine components. The second tank within the confines of wall 52 is preferably used for heating lubricant received from the engine. Wall 47 is produced from a heat conductive material and has a series of radial fins 57 fixed along its outer surface and arranged parallel to the longitudinal axis of heating element 20. Fins 27 lead from wall 47 outward to a location spaced from the inside surface of wall 52. They provide increased heat conductive areas for transmission of heat from the interior of the first tank to the interior of the second tank.

The present apparatus utilizes two supply pumps shown at 22 and 62. Pump 22 is used for conditioning of coolant. Pump 62 is used for conditioning of lubricant. The inlet of pump 22 is operatively connected by conduit 23 to a location interposed between pump 43 and radiator 42. Conduit 23 includes a suitable check valve 24 and a releasable coupling 25. In actual use, conduit 23 will normally be a flexible hose which can be selectively disconnected from the engine components. Check valve 24 permits passage of coolant to conduit 23 and pump 22, but does not permit entry of liquid into the recirculation system 41 upstream of pump 43 when the engine 10 is operating.

Pump 22 is powered by an electric motor 26. Its outlet at 27 is connected to a conduit 30 leading to the inlet 50 of the inner tank of the heat exchanger or conditioning tank 18. Also interposed in consuit 30 is a thermostatic element 31.

The outlet of the inner tank 51 is connected by a conduit 32 and an adjustable flow control valve 28 to a location within the recirculation system 41 downstream from pump 43. A releasable coupling 34 is also provided in conduit 32. Conduit 32, which is typically a hose, can therefore be readily disconnected from recirculation system 41.

The conditioning elements associated with the lubricant recirculation system 11 are very similar to those just described with respect to the coolant recirculation system 41. Pump 62 is provided with liquid from the engine pan 12 by means of a conduit 63 having an interposed check valve 64 and releasable coupling 65 of the types generally described above. The lubricant supply pump 62 is powered by a motor 69. The lubricant, under pressure, is directed through conduit 65 from pump 62 to the interior of the outer or second tank between walls 47 and 52. Conduit 65 leads to the inlet 55 of tank 18. The warmed lubricant leaves tank 18 at outlet 56, and is directed through a conduit 66 back to a location within the liquid recirculation system 11 immediately downstream from pump 13. Conduit 66 also is provided with a releasable coupling 67.

Interposed in the outlet coupling 66 is a preset flow control valve 70 and an associated flow control monitoring switch 71.

All of the elements in the conditioning system are electrically controlled and monitored to assure proper operation of the conditioning apparatus to maintain engine 10 in readiness for use. An electric control unit shown generally at 72 is connected to the motors 26 and 69 for the pumps 22, 62 respectively. The temperature of the coolant is monitored by the thermostatic element 30, and the flow rates of coolant and lubricant are monitored by flow responsive switches 29 and 71 respectively. Should flow be interrupted, the electric control unit 72 is capable of shutting down one or both pumps 22 to assure against damage to the liquids or equipment. Thermostatic switch 31 further monitors the temperature of the coolant and properly operates the heating element 20 through heater control 21.

During use of the apparatus, coolant is pumped from system 41 by operation of pump 22 and is circulated through the inner tank of the conditioning tank 18. Operation of heating element 20 adds heat to the coolant, which flows continuously from conduit 23 to conduit 32, which interjects it back into system 41. The conduits 23 and 32 effectively bypass the engine coolant pump 43, so that the warmed coolant flows through engine 10 in the same path through which it is directed during engine operation. The warmed coolant supplies heat to the engine components before being returned to radiator 42 through the usual conduit 46. Temperature of the coolant is monitored by the thermostatic switch 31.

The lubricant from pan 12 is drawn through conduit 63 by operation of pump 62. It is directed through the second or outer tank in the conditioning tank 18, where heat is supplied from the interior coolant tank. The more heat sensitive lubricant is therefore shielded from the electrical resistance element 20 by the interposed coolant liquid. The warmed lubricant is then injected back into the recirculation system 11 to bypass the normal lubricant pump 13. It flows under pressure through the various engine components in the same fashion as when the engine 10 is operational. This not only adds heat to the engine to maintain all its parts in readiness for use, but also continuously replenishes the lubricant film between the various moving parts. All of the engine components are therefore continuously lubricated or washed with lubricant and are ready for use without any initial dry startup.

FIGS. 2 through 5 show a physical arrangement of these components on a supporting frame or pallet 17. The frame 17 can be portable or stationary, depending upon the manner in which the equipment is being used. As an example, frame 17 might be maintained outdoors in a stationary position for attachment to portable vehicles, such as trucks or railroad locomotives. Alternatively, the frame or pallet 17 might be portable and readily moved or carried to the location of the equipment with which it is to be utilized.

In FIGS. 2 through 5, pump 62 is shown as a rotary pump mechanically driven by a separate motor 26. Pump 22 is illustrated as a self-contained pump and motor unit, such as an electromagnetically driven positive displacement pump. The other compartments shown in FIGS. 2 through 5 are believed to be readily identifiable with respect to the previous description of FIG. 1.

Under normal use, the thermostatic element 31 is preset to the temperature at which the liquids are desired while circulating through engine 10. Until the circulating coolant reaches this temperature the thermostatic element 31 will continue operation of heating element 20 to add heat to the liquid system. The coolant is heated by direct contact along the heating element 20. The pressurized lubricant is heated by conduction through wall 47 and fins 57, which in turn are heated by the warm coolant within the interior tank of the heat exchanger. When the coolant reaches the desired temperature, thermostatic switch 31 will cause electric control unit 72 to open the circuit to heating element 20 until the liquid temperature again falls below this predetermined temperature level.

To insure against damage to the heating element 20 due to lack of liquid recirculation, the flow control switch 29 monitors the passage of coolant through the conditioning tank 18. So long as flow continues, switch 29 remains inactive. It is activated by lack of flow through conduit 30. This activation is used to immediately open the circuit to the heating element 20 to prevent damage to it and to prevent damage to the coolant within conditioning tank 18, which in some cases is very sensitive to heat. Should flow be only momentarily interrupted, switch 29 will be deactivated and the circuit to heating element 20 will again be completed through operation of the electric control unit 72. However, the unit 72 should include a time delay circuit (not shown) capable of monitoring activation of flow control switch 29. If flow has ceased for a predetermined time, controls 38 will then shut down the entire apparatus and require manual restarting of it. In this way, operation of the apparatus can be automatically monitored while assuring that there will be no damage to liquid being circulated, nor to the equipment or engine 10. Similarly, the switch 71 is used to monitor flow of pressurized lubricant through the recirculation system 11 and can be used to shut down pump 62 when a malfunction occurs.

The purpose of the apparatus is to provide circulation of coolant and lubricant through the equipment or engine 10 while it is not operational. Pumps 22 and 62 are preset to direct liquid to the systems 41, 11 respectively at pressures similar to the normal operating pressures of the coolant and lubricant during use of the equipment or engine. Thermostatic control 31 is set in conjunction with heating element 20 to either heat or cool the liquids to temperatures similar to normal equipment or engine operating temperatures. The flow control valves 28 and 70 are preselected or adjusted to assure that the rate of flow of the two liquids will simulate normal operating conditions. Thus, the coolant and lubricant, or other liquids used in similar equipment, can be continuously circulated through the nonoperational equipment to effect heat transfer while the equipment (or engine) is not in use. In the case of a lubricant, surface lubrication is also effected, maintaining the movable elements of the equipment in readiness for startup and subsequent use. This prelubrication of the nonoperational equipment surfaces minimizes the normal wear encountered between movable surfaces that have remained stationary for substantial periods of time.

Various modifications might be made with respect to the details of the equipment, while remaining within the boundaries of the apparatus discussed above. For these reasons, the following claims are set out as definitions of the disclosed invention.

Having described my invention, I claim:

1. An apparatus adapted to maintain an engine in readiness for operation wherein the engine is of a type that includes a closed coolant recirculation system having a coolant supply and a coolant recirculating pump as well as a closed lubricant recirculation system having a lubricant supply and a lubricant recirculating pump; said apparatus comprising:

a coolant supply pump adapted to be mounted external to an engine, said coolant supply having an inlet and an outlet;

first conduit means for interconnecting the coolant supply of an engine to the inlet of said coolant supply pump;

a lubricant supply pump adapted to be mounted external to an engine, said lubricant supply pump having an inlet and an outlet;

second conduit means for interconnecting the lubricant supply of the engine to the inlet of said lubricant supply pump;

heat exchanger means for raising the temperature of liquid flowing therethrough to a constant predetermined temperature, substantially equal to the normal temperature of the coolant while the engine is operational;

said heat exchanger means having concentrically positioned separate coolant and lubricant chambers each having an inlet and an outlet;

means operatively connected between the outlet of the coolant supply pump and the inlet of the coolant chamber of said heat exchanger means for directing coolant under pressure to the heat exchanger means;

means operatively connected between the outlet of the lubricant supply pump and the inlet of the lubricant chamber of said heat exchanger means for directing lubricant to the heat exchanger means at a pressure substantially equal to the normal pressure of the lubricant in the lubricant recirculation system while the engine is operational;

third conduit means for interconnecting the outlet of the coolant chamber to the coolant recirculation system of an engine at a location downstream from its coolant recirculating pump;

and fourth conduit means for interconnecting the outlet of the lubricant chamber to the lubricant recirculation system of an engine at a location downstream from its lubricant recirculating pump.

2. An apparatus as set out in claim 1 wherein the lubricant chamber of said heat exchanger means surrounds the coolant chamber.

3. An apparatus as set out in claim 1 wherein the heat exchanger means comprises:

an elongated heating element;

an elongated interior tank surrounding the heating element, said interior tank having a coolant inlet at one end and a coolant outlet at its remaining end;

and an elongated exterior tank surrounding the interior tank, said exterior tank having a lubricant inlet at one end and a lubricant outlet at its remaining end.

4. An apparatus as set out in claim 3 wherein the heating element, interior tank and exterior tank of the heat exchanger means are each cylindrical in shape and are coaxially arranged with respect to one another.

* * * * *